United States Patent [19]

Moon

[11] Patent Number: 5,030,107

[45] Date of Patent: Jul. 9, 1991

[54] LCD CLUSTER CONNECTOR

[75] Inventor: Sung J. Moon, Ansan, Rep. of Korea

[73] Assignee: Molex Incorporated, Lisle, Ill.

[21] Appl. No.: 610,674

[22] Filed: Nov. 8, 1990

[51] Int. Cl.[5] ..... H01R 9/09

[52] U.S. Cl. ..... 439/62; 439/78; 439/748

[58] Field of Search ..... 439/55, 59, 62, 78, 439/65, 80, 81, 83, 84, 630, 631, 746, 747, 748

[56] References Cited

U.S. PATENT DOCUMENTS

| | | | |
|---|---|---|---|
| 2,994,056 | 7/1961 | Fox | 439/62 |
| 3,596,235 | 7/1971 | Hendriklaan | 439/748 |
| 3,732,531 | 5/1973 | Bouley | 439/748 |
| 4,713,013 | 12/1987 | Regnier et al. | 439/62 |
| 4,891,023 | 1/1990 | Lopata | 439/746 |
| 4,894,017 | 1/1990 | Stein et al. | 439/78 |

FOREIGN PATENT DOCUMENTS

| | | | |
|---|---|---|---|
| 3023614 | 1/1982 | Fed. Rep. of Germany . | |
| 1408761 | 7/1965 | France | 439/746 |
| 1001221 | 8/1965 | United Kingdom | 439/746 |

*Primary Examiner*—Neil Abrams
*Assistant Examiner*—Khiem Nguyen
*Attorney, Agent, or Firm*—Louis A. Hecht; Stephen Z. Weiss; Charles S. Cohen

[57] ABSTRACT

An LCD cluster connector is provided for automotive applications. The connector includes a molded nonconductive housing having a plurality of stamped terminals therein. Each terminal is redundantly locked to the housing to prevent movement in response to vibration, shock or other such forces inherent in the automotive environment. The positive redundant locking avoids insert molding and is achieved automatically during insertion of the terminals into the housing. The terminals are configured to positively position the LCD connector relative to a printed circuit board.

15 Claims, 2 Drawing Sheets

LCD CLUSTER CONNECTOR

BACKGROUND OF THE INVENTION

Liquid crystal display (LCD) clusters are employed to provide variable illuminated displays on instruments panels, calculators, computers, watches, and many other electronic or electromechanical devices. LCD clusters are particularly well suited for the instruments panels of automotive vehicles. More particularly, increasingly complex and more extensive electronic circuits are employed in automotive vehicles to monitor vehicular operating conditions. The electronic circuits of an automotive vehicle monitor and report basic vehicular functions and operating conditions such as vehicular speed, engine speed, fuel level and oil pressure. More sophisticated circuits also monitor door and trunk locks, tire pressure, sound system components, seat belt operations and many other functions. LCD clusters are well suited to providing clear readable, visual indications of these and other monitored engine vehicular operating conditions.

The typical LCD cluster comprises a liquid crystal matrix appropriately mounted in or to a substrate which has a plurality of discrete conductive regions disposed in spaced relationship along a linear mating edge thereof. The conductive regions are disposed along the mating edge to be engaged by terminals in an LCD cluster connector. More particularly, the prior art LCD cluster connector comprises a non-conductive housing having an elongated slot for receiving the mating edge of an LCD cluster. The connector further includes a plurality of spaced apart terminals. Each terminal has one or more contact beams adjacent to the slot of the housing and disposed to contact a corresponding conductive region along the mating edge of the LCD cluster. Thus, the mating edge of the LCD cluster is slid or rotated into the slot of the connector such that the discrete conductive regions along the mating edge of the LCD cluster will be engaged by corresponding terminals in the connector.

Automotive vehicles are not ideal environments for the complex electronic circuitry described above. An automotive vehicle is subjected to almost continuous vibration and frequent physical shock during its normal usage. Automotive vehicles also are subjected to extreme ranges of temperature and are frequently subjected to moisture and corrosive materials. Vehicles also undergo periodic maintenance by technicians who often are not trained to handle the small, fragile electronic circuits properly. Hence, it is common for an automotive mechanic to inadvertently damage electronic circuitry while performing routine mechanical maintenance on a vehicle.

Prior art LCD connectors that are well suited for office machines, computers, clocks or the like often are not well suited for automotive applications. More particularly, the hostile conditions to which an automobile is subjected create the potential for minor shifts of terminals in the LCD connector housing. Such shifts can cause the terminal of the LCD connector to disengage from the conductive region along the mating edge of the LCD cluster. Such disengagement may cause the LCD cluster to fail in reporting a vital engine function or vehicular operation condition or to misreport such condition.

In view of the hostile automotive environment, the LCD connectors intended for automotive applications have employed insert molding for positioning the terminals in the LCD connector housing. Insert molding typically will achieve accurately positioned terminals that are surrounded and supported by the unitary matrix of plastic material and that are not subject to shifting even in response to extensive vibration or shock or extreme ranges of temperature. However, insert molding imposes a substantial cost penalty on the LCD connector. In this regard, the electronics industry is very competitive and even small cost penalties or savings can be very significant.

An example of an LCD connector that is not insert molded is shown in German Patentschrift 30 23 614 which issued on Mar. 19, 1987. The terminal shown in the LCD connector of the German reference is not securely positioned in the LCD connector housing and therefore would be likely to shift in response to the above described hostile automotive environmental conditions.

In view of the above, it is an object of the subject invention to provide an LCD connector that is well suited for automotive applications.

Another object of the subject invention is to provide an LCD connector that avoids insert molding of terminals in the connector housing.

It is another object of the subject invention to provide an automotive LCD connector having terminals that are positively and accurately positioned relative to the LCD cluster receiving slot in the housing.

Still a further object of the subject invention is to provide an LCD connector that is accurately and conveniently mountable to a circuit board.

SUMMARY OF THE INVENTION

The subject invention is directed to an LCD connector which comprises a nonconductive housing having an elongated mating slot formed therein and dimensioned for receiving the mating edge of an LCD cluster. The housing further includes a plurality of terminal receiving cavities extending generally from the area of the mating slot to an exterior face of the housing. The LCD connector further includes a plurality of electrically conductive terminals that are lockingly engageable in a corresponding one of the terminal receiving cavities of the LCD connector housing. Each terminal includes a base and at least one deflectable contact beam cantilevered from the base and extending into proximity with the mating slot in the housing. More particularly, each contact beam includes at least one contact region for engaging a corresponding discrete conductive area along the mating edge of the LCD cluster. Each terminal further includes a circuit engaging end for achieving electrical contact with another circuit, such as a conductive region on a printed circuit board. In particular, the circuit engaging end of each terminal may comprise a solder tail for soldered electrical connection to a printed circuit.

The housing of the LCD connector and each terminal thereof are constructed for secure redundant locked engagement with one another. More particularly, each terminal may include plural locking means for locked engagement with corresponding structure in the connector housing. Each locking means may comprise a locking edge on a portion of each terminal spaced from the base thereof. The locking edge may be in opposed generally facing relationship to the base of the associated terminal. Each locking means may further include a ramped edge for generating deflection of the locking means and/or the housing as the terminal is urged into the associated terminal receiving cavity of the housing. However, after sufficient or complete insertion of the terminal into the associated cavity, each locking means and/or the housing will return toward an undeflected condition, thereby enabling a selected portion of the housing to be lockingly engaged between the base of the terminal and the locking edge thereof.

Each terminal may further comprise secondary locking means for locking engagement with the housing of the connector. The secondary locking means may define a locking notch. The locking notch may be defined by an enlarged positioning shoulder formed on the base and spaced from a first contact beam. More particularly, the enlarged positioning shoulder of each terminal may be disposed intermediate the solder tail or other such circuit engaging means and the first deflectable contact beam of the terminal. The enlarged positioning shoulder may further be dimensioned and disposed to accurately position both the terminals and the housing relative to a circuit board. Secure accurate positioning of the LCD cluster connector to a circuit board may further be achieved by the solder tail or other such circuit engaging means. In this regard, the solder tail may extend generally parallel to the contact beams and may be spaced therefrom a selected distance for passing through and/or engaging a through hole in a circuit board.

In a preferred embodiment, as explained further below, each terminal comprises first and second contact beams which are deflectably cantilevered from the base. The first contact beam includes a single convexly arcuate contact edge on an edge region thereof generally facing the second contact beam. The opposed edge of the first contact beam includes a locking edge extending generally orthogonal to the longitudinal direction of the first contact beam and in generally opposed facing relationship to the base and slightly spaced therefrom. The space between the locking edge of the first contact beam and the base is dimensioned to locking engage a corresponding structure on the housing. Portions of the first contact beam adjacent the locking edge but spaced further from the base are ramped to facilitate deflection of the first contact beam generally toward the second contact beam during insertion of the terminal into the housing.

In a similar manner, the second contact beam of the preferred terminal includes first and second spaced apart convexly arcuate contact edges disposed in opposed facing relationship to the first contact beam. The first convexly arcuate contact edge of the second contact beam defines a minor distance to the base which is less than the distance between the base and the corresponding contact surface on the first contact beam. However, the second convexly arcuate contact edge of the second contact beam is substantially at the end of the second contact beam and defines a major distance to the base which exceeds the distance between base and the contact edge of the first contact beam.

The opposed edge of the second contact beam defines a locking edge extending generally orthogonal to the longitudinal direction of the second contact beam and in generally opposed facing relationship to the base. The distance between the base and the second locking edge preferably exceeds the distance between the base and the first locking edge which is disposed on the first contact beam. In particular, the second locking edge preferably is disposed on a portion of the second contact beam generally adjacent the free end thereof and specifically is disposed to engage corresponding structure on the LCD cluster connector housing.

The preferred terminal further includes an enlarged positioning shoulder having orthogonally aligned engagement edges thereon. The first engagement edge of the positioning shoulder of the base extends generally parallel to the second contact beam and is disposed in spaced relationship thereto. This first engagement edge is disposed to lockingly engage an exterior surface of the housing. The second engagement edge of the shoulder is disposed to engage a surface region of the circuit board to which the LCD cluster connector is mountable. A solder tail, pin or other such circuit engaging means extends generally parallel to the contact beams from a location on the base generally adjacent the mounting portion thereof. The solder tail or pin is disposed to be engaged in a through hole of a circuit board such that the LCD cluster connector is accurately positioned relative to the circuit board when the second engagement edge of the mounting shoulder of the terminal engages the circuit board.

DETAILED DESCRIPTION OF THE PREFERRED EMBODIMENT

Figure 1:
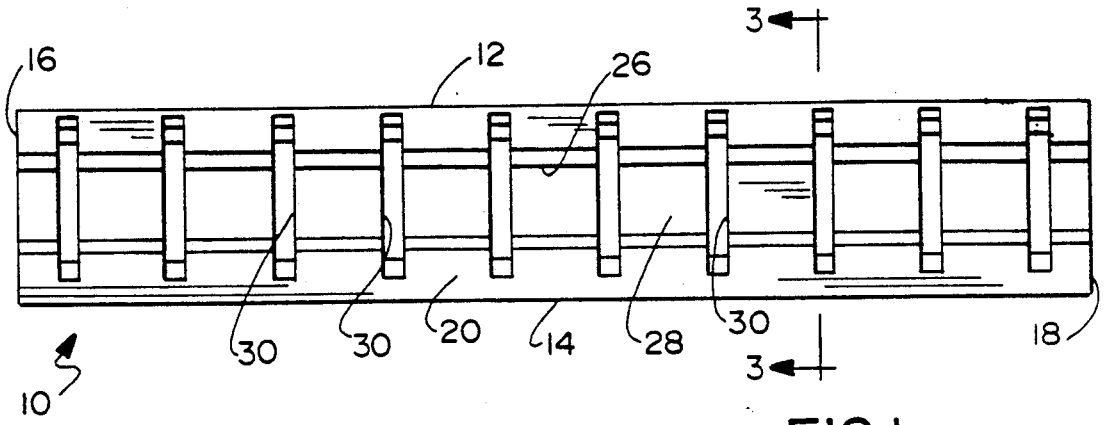
FIG. 1 is top plan view of the housing of the LCD cluster connector in accordance with the subject invention.
Figure 2:
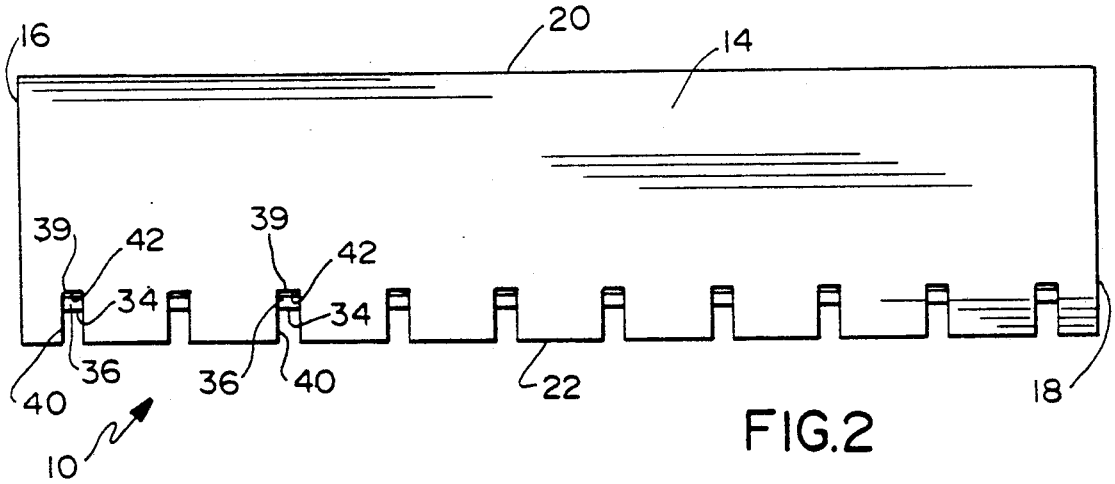
FIG. 2 is a side elevational view of the housing shown in FIG. 1.
Figure 3:
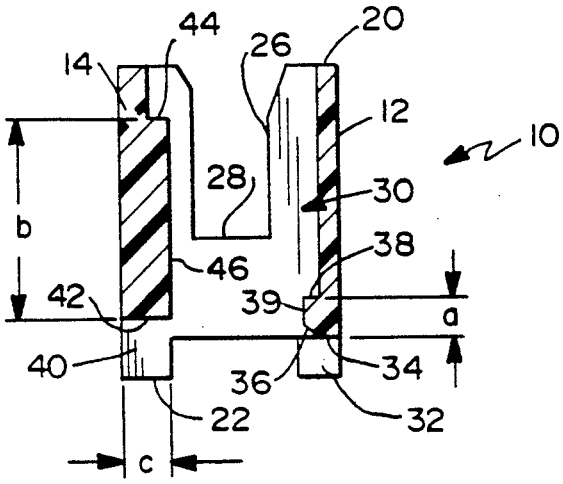
FIG. 3 is a cross-sectional view taken along line 3—3 in FIG. 1.

The housing for the LCD connector of the subject invention is identified generally by the numeral 10 in FIGS. 1-3. The housing 10 is unitarily molded from a nonconductive material, such as a glass filled polyester. More particularly, the housing is molded to define an elongated rectangular configuration having opposed longitudinally extending first and second side walls 12 and 14, opposed first and second ends 16 and 18, a top face 20 and an opposed bottom face 22. The housing is further molded to define a longitudinally extending mating slot 24 extending into the top face 20 thereof and terminating at an inner base 26 intermediate the opposed top and bottom faces 20 and 22. The mating slot 24 extends substantially the entire length of the housing 10 between the longitudinally extending side walls 12 and 14 thereof. The mating slot 24 is dimensioned to receive the mating edge of an LCD cluster (not shown). As shown most clearly in FIG. 3, portions of the upper face 20 adjacent the slot 24 are defined by chamfers to facilitate the initial entry of the LCD cluster into the mating slot 24.

The housing 10 is molded to define a plurality of terminal receiving cavities 30 which extend from the bottom face 22 to the mating slot 24 and which are substantially equally spaced along the length of the housing 10. Each terminal receiving cavity 30 is substantially planar, with the plane thereof extending substantially orthogonal to the longitudinal direction of the housing 10. Furthermore, each cavity 30 is dimensioned and configured to closely engage and lockingly retain a corresponding terminal therein as explained in greater detail below.

With reference to FIGS. 2 and 3, each cavity 30 is defined by a first notch 32 extending through the first side wall 12 adjacent the bottom face 22. The first notch 32 is characterized by a first lower locking surface 34 which is generally parallel to the bottom face 22 of the housing 10 and faces away from the top face 20 thereof. Each terminal receiving cavity 30 is further defined by a ramped surface 36 extending angularly from the first lower locking surface 34 and toward a central area of the terminal receiving cavity 30. The ramped surface 36 will facilitate the inward deflection of a contact beam on a terminal used with the housing 10 as explained below. The terminal receiving cavity 30 further is defined by a first upper locking surface 38 which is generally parallel to the first lower locking surface 34, but which is spaced closer to the top face 20 of the housing 10. The distance between the first lower locking surface 34 and the first upper locking surface 38 is defined by dimension "a" in FIG. 3. A first vertical surface 39 extends from the ramped surface 36 to the first upper locking surface 38.

In a similar manner, each terminal receiving cavity 30 is also defined by a second notch 40 through the second wall 14 and adjacent the bottom face 22 of the housing 10. The second notch 40 of each terminal receiving cavity is defined in part by a second lower locking surface 42 which is generally parallel to the lower face 22 of the housing 10 and which is facing away from the upper face 20 thereof. Each cavity 30 further is characterized by a second upper locking surface 44 which is generally in proximity to the upper face 20 and the second side wall 14 of the housing 10. In particular, the second upper locking face 44 faces away from the bottom face 22 of the housing. The distance between the second upper locking surface 44 and the second lower locking surface 42 is identified by the numeral "b" in FIG. 2 and is substantially in excess of the distance "a" between the first upper locking surface 38 and the first lower locking surface 34. A second vertical surface 46 extends between the locking surfaces 42 and 44 and generally parallel to the first vertical surface 39 on the opposite side of the housing. The thickness of the second side wall 14, measured orthogonal to the second vertical surface 46 is identified by dimension "C" in FIG. 3.

Figure 4:
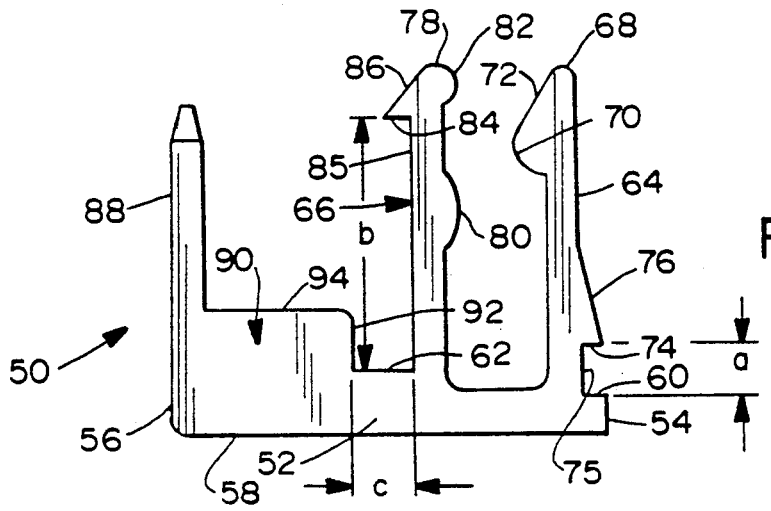
FIG. 4 is a front elevational view of a terminal for the LCD cluster connector of the subject invention.
Figure 5:
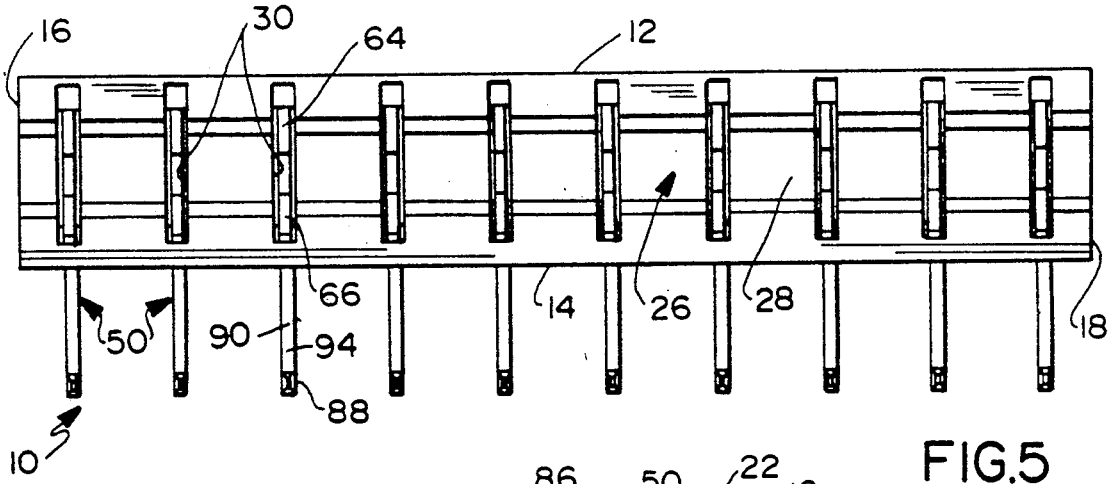
FIG. 5 is a top plan view of the assembled LCD cluster connector.

The terminal of the subject invention is identified generally by the numeral 50 in FIG. 4. The terminal 50 is stamped from a unitary piece of metallic material, such as brass or a brass alloy which may be at least locally plated. The stamping retains the planar configuration of the metal material and ensures accurate dimensions of the terminal and high normal contact forces of deflectable members, as explained further herein.

The terminal 50 is stamped to define an elongated base 52 having opposed first and second longitudinal ends 54 and 56 and a bottom edge 58 extending generally linearly therebetween. The terminal 50 is dimensioned such that the bottom edge 58 will be spaced upwardly from the lower face 22 of the housing 10 as explained further herein. The opposite longitudinally extending side of the base 52 is characterized by a first lower locking edge 60 which is generally adjacent the first end 54 of the base 52 and which is generally parallel to the bottom edge 58. The base further is stamped to define a second lower locking edge 62 which is intermediate the opposed first and second ends 54 and 56 and which also extends substantially parallel to the bottom edge 58 of the base 52.

The terminal 50 further defines first and second cantilevered contact beams 64 and 66 respectively which extend upwardly from the base 52 at locations thereon intermediate the first and second lower locking edges 60 and 62 respectively. The first contact beam 64 is an elongated generally linear cantilevered member having an accurate free end 68 remote from the base 52. The first contact beam 64 further includes a convexly arcuate contact edge 70 on the longitudinal side of the first contact beam 64 which faces the second contact beam 66, and at a location along the first contact beam 64 generally in proximity to the free end 68 thereof. A ramped surface 72 extends between the free end 68 and the contact edge 70 of the first contact beam 64 and functions to guide an LCD cluster into the space between the contact beams 64 and 66 and generates the necessary deflection of the first contact beam 64 as explained below.

The side of the first contact beam 64 facing away from the second contact beam 66 is characterized by a first upper locking edge 74 which is disposed in spaced parallel relationship to the first lower locking edge 60. The distance "a" between the first lower locking edge 60 and the first upper locking edge 74 is substantially equal to the distance "a" between the first lower locking surface 34 and the first upper locking surface 38 on the housing 10 as explained above and illustrated in FIG. 3. A first vertical edge 75 extends orthogonally between the first upper and lower locking edges 74 and 60 and will lockingly engage the first vertical surface 39 on the housing 10. The first contact beam 64 is further characterized by a ramped surface 76 extending between the first upper locking edge 74 and a location on the first contact beam 64 intermediate the length thereof. The ramped edge 76 will generate deflection of the first contact beam 64 toward the second contact beam 66 during insertion of the terminal 50 into the housing 10 as explained below.

The second contact beam 66 also is an elongated generally linear structure having a free end 78 remote from the base 52. The second contact beam 66 is further characterized by first and second convexly arcuate contact edges 80 and 82 disposed along the side thereof facing the first contact beam 64. The distance between the first convexly arcuate contact edge 80 and the base 52 is less than the corresponding distance between the contact edge 70 of the first contact beam 64 and the base 52. The second convexly arcuate contact edge 82 is spaced from the base 52 a distance which exceeds the distance between the contact edge 70 of the first contact beam 64 and the base 52.

The side of the second contact beam 66 facing away from the first contact beam 64 is characterized by a second upper locking edge 84 disposed in spaced parallel relationship to the second lower locking edge 62. The second upper locking edge 84 is disposed generally in proximity to the free end 78 of the second contact beam 66 with the distance "b" between the second lower and upper locking edges 62 and 84 respectively being approximately equal to the distance between the second lower locking surface 42 and the second upper locking surface 44 of the housing 10 as described and illustrated above. A second vertical edge 85 extends orthogonally between the second lower and upper locking edges 62 and 84 and will lockingly engage the second vertical surface 46 on the housing 10. The second contact beam 66 is further characterized by a ramped edge 86 which extends between the free end 78 thereof and the second upper locking edge 84. The ramped edge 86 will generate deflection of the second contact beam 66 toward the first contact beam 64 during insertion of the terminal 50 into the housing 10.

The terminal 50 is further characterized by a pin 88 extending from the base 52 generally adjacent the second end 56 thereof and aligned substantially parallel to the first and second contact beams 64 and 66. The pin 88 is dimensioned to be received in a through hole in a circuit board as explained further herein.

Portions of the terminal 50 intermediate the second lower locking edge 62 and the pin 88 are characterized by a generally rectilinear positioning shoulder 90. The positioning shoulder 90 is characterized by a shoulder locking edge 92 extending substantially orthogonal from the lower locking edge 62 and substantially parallel to the vertical edge 85 of the second contact beam 66. The distance "c" between the vertical edge 85 of the second contact beam 66 and the shoulder locking edge 92 of the positioning shoulder 90 is substantially equal to the distance "c" defining the thickness of the second side wall 14 of the housing 10. The positioning shoulder 90 is further characterized by a positioning edge 94 extending generally parallel to the bottom edge 58 of the terminal 50.

The terminal 50 is mounted to the housing 10 by merely urging the terminal 50 upwardly into one of the corresponding terminal receiving cavities 30 of the housing 10. More particularly, and with reference to FIGS. 3 and 6, it will be appreciated that the initial movement of the terminal 50 into the terminal receiving cavity 30 will cause the ramped edge 86 of the second contact beam 66 to slidingly engage the second lower locking surface 42 of the housing 10. This engagement will generate the deflection of the second contact beam 66 generally toward the first contact beam 64, thereby permitting continued upward advancement of the terminal 50 into the corresponding terminal receiving cavity 30 of the housing 10. Such further upward advancement of the terminal 10 will urge the ramped edge 76 of the first contact beam 64 into sliding engagement with the ramped surface 36 of the housing 10 to generate a similar deflection of the second contact beam 66 toward the first contact beam 64.

After sufficient insertion, the respective first and second upper locking edges 74 and 84 will be aligned with the respective first and second upper locking surfaces 38 and 44 in the terminal receiving cavity 30, thereby causing the first and second contact beams 64 and 66 to return toward an undeflected condition. In this position, the first lower and upper locking edges 60 and 74 of the terminal 50 will securely engage the corresponding first lower and upper locking surfaces 34 and 38 in the terminal receiving cavity 30 of the housing 10. Simultaneously, the respective second lower and upper locking edges 62 and 84 of the terminal 50 will engage the corresponding second lower and upper locking surfaces 42 and 44 in the terminal receiving cavity 30 of the housing 10. In this locked condition, the vertical edge 85 of the second contact beam 66 will be disposed substantially in abutting face-to-face contact with the surface 45 extending orthogonally between the second lower and upper looking surfaces 42 and 44 in the terminal receiving cavity 30 of the housing 10.

In this fully inserted condition, the shoulder locking edge 92 will be securely engaged in abutting face-to-face relationship with outwardly facing portions of the second side wall 14 adjacent the second lower locking surface 42. Thus, the terminal 50 is redundantly locked in the terminal receiving cavity for resisting forces that might otherwise generate movement between the terminal 50 and the housing 10. More particularly, vertical movement of the terminal between the upper and lower faces 20 and 22 is prevented by engagement of the first lower and upper locking edges 60 and 64 of the terminal 50 with the corresponding first lower and upper locking surfaces 32 and 38 of the housing 10. This vertical movement is further prevented by a similar engagement of the second lower and upper locking edges 62 and 84 of the terminal 50 with the corresponding second lower and upper locking surfaces 42 and 44 of the housing 10. In a similar manner, horizontal movement between the first and second longitudinally extending side walls 12 and 14 of the housing 10 is prevented by: engagement of the vertical edge 75 of the first contact beam 64 with the corresponding vertical face 39 in the terminal receiving cavity 30; engagement of the shoulder locking edge 92 with the second longitudinally extending wall 14; and the engagement of the vertical edge of the second contact beam 66 with the corresponding vertical surface 46 of the terminal receiving cavity 30. It will be appreciated that in this fully inserted condition, electrical contact with an LCD cluster is achieved only by deflection of the first contact beam 64. Corresponding deflection of the second contact beam 66 is prevented by the secure locked engagement described above. However, forces generated by the deflection of the resilient first contact beam 64 will urge the LCD cluster toward the second contact beam for achieving a high quality electrical connection.

Figure 6:
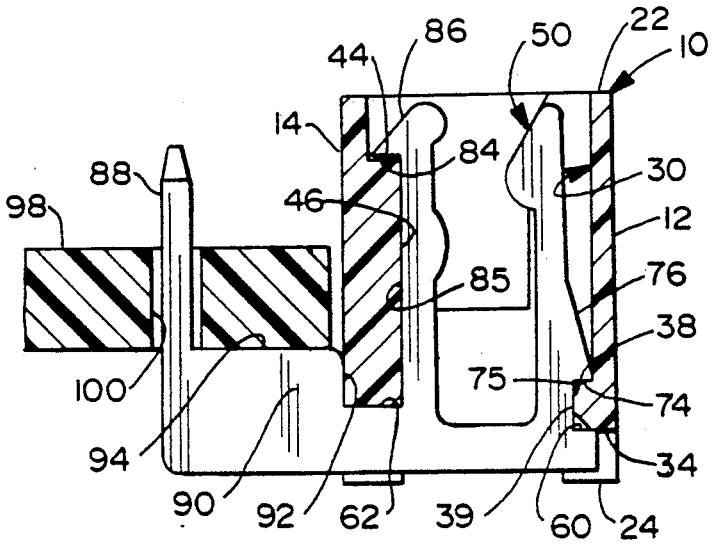
FIG. 6 is a cross-sectional view taken along line 6—6 in FIG. 5.

In addition to the locked engagement of the terminal 50 in the housing 10, the terminal 50 also achieves accurate positioning relative to a printed circuit board 98 as shown in FIG. 6. More particularly, the positioning edge 94 of the positioning shoulder 90 is disposed in abutting face-to-face contact with the printed circuit board 98 when the pin 88 is inserted a proper distance through the through hole 100 in the circuit board 98.

In summary, an LCD cluster connector is provided that avoids the need to insert mold the terminal therein. More particularly, the terminal is stamped and the housing is formed to achieve redundant positive locking of the terminal in a corresponding terminal receiving cavity of the housing. The redundant locking securely traps portions of the housing between structures of the terminal on both opposed lateral sides of the connector. Additionally, the terminal engages a plurality of laterally facing surfaces of the housing to prevent horizontal or transverse shifting of the terminal therein. Furthermore, the terminal includes a positioning shoulder for accurately aligning the terminal and the entire connector housing to a printed circuit board with which the LCD cluster connector is employed.

While the invention has been described with respect to a preferred embodiment, it is apparent that various changes can be made without departing from the scope of the invention as defined by the appended claims.

We claim:

1. A terminal stamped from a unitary piece of electrically conductive material for electrically contacting a conductive region on an LCD cluster, said terminal comprising an elongated base having opposed first and second ends, first an second contact beams cantilevered from said base intermediate the opposed first and second ends thereof and disposed in spaced generally parallel relationship to one another for receiving a selected portion of the LCD cluster therebetween and connecting means generally in proximity to the second end of the base for electrical connection to a selected circuit, wherein the improvement comprises:

a first lower locking edge formed on the base intermediate the first end thereof and the first contact beam, a first upper locking edge defined on the first contact beam in opposed generally parallel facing relationship to the first lower locking edge, a second lower locking edge defined on a portion of the base between the second end thereof and the second contact beam and a second upper locking edge defined on the second contact beam in opposed generally parallel facing relationship to the second lower locking edge, whereby the first lower and upper locking edges and the second lower and upper locking edges of the terminal are lockingly engageable with corresponding structure of an LCD cluster connector housing.

2. A terminal as in claim 1 wherein the first contact beam includes a contact edge on a side of said first contact beam generally facing the second contact beam, the first upper locking edge being disposed on a side of the first contact beam generally opposite the contact edge thereof and being disposed intermediate the contact edge and the base of the terminal.

3. A terminal as in claim 2 wherein the first contact beam further comprises a ramped edge intermediate the first upper locking edge and the end of the first contact beam remote from the base, said ramped edge being aligned to deflect the first contact beam toward the second contact beam during insertion of the terminal into the housing.

4. A terminal as in claim 1 wherein the distance between the base and the second upper locking edge is greater than the distance between the base and the first upper locking edge.

5. A terminal as in claim 4 wherein the second contact beam further comprises a tapered edge intermediate the second upper locking edge and the end of the second contact beam remote from the base, said tapered edge being aligned to deflect the second contact beam toward the first contact beam during insertion of the terminal into the housing.

6. A terminal as in claim 1 further comprising a positioning shoulder defined on a portion of the base intermediate the second end thereof and the second lower locking edge, the positioning shoulder being defined by a shoulder locking edge spaced from and generally parallel to the second contact beam for lockingly engaging a portion of the housing of the LCD connector intermediate the positioning shoulder and the second contact beam.

7. An LCD cluster connector having an elongated housing with opposed upper and lower faces and opposed first and second longitudinally extending side walls, an elongated mating slot extending into the upper face and being dimensioned to receive a mating edge of an LCD cluster, a plurality of terminal receiving cavities formed in the housing and extending generally from the mating slot to the lower face of the housing, said LCD connector further comprising a plurality of terminals disposed respectively in the terminal receiving cavities of the housing, each said terminal comprising a base disposed generally adjacent the lower face of the housing, said base having a first end in proximity to the first side wall of the housing and a second end extending from the second side wall of the housing for electrical connection to a circuit, each said terminal further comprising first and second contact beams extending from the base and toward the slot of the housing and generally adjacent respective the first and second side walls of the housing, wherein the improvement comprises:

said housing being formed to define a first lower locking surface generally adjacent the first side wall thereof, a first upper locking surface disposed between the first lower locking surface and the upper face of the housing, a second lower locking surface generally adjacent the second side wall of the housing and a second upper locking surface intermediate the second lower locking surface and the upper face of the housing; and said terminal being stamped to define a first lower locking edge generally adjacent the first end of the base, a first upper locking edge defined on the first contact beam and spaced from the first lower locking edge by a distance substantially equal to the distance between the first upper and lower locking surfaces of the housing, a second lower locking edge intermediate the second contact beam and the second end of the base and a second upper locking edge defined on the second contact beam and spaced from the second lower locking edge by a distance substantially equal to the distance between the second upper and lower locking surfaces of the housing, the locking edges of each terminal being lockingly engaged with the locking surfaces of the housing for positively redundantly retaining the terminal in a selected one of the terminal receiving cavities of the housing.

8. A connector as in claim 7 further comprising a positioning shoulder intermediate the second contact beam and the second end of the base, the positioning shoulder being spaced from the second contact beam such that the positioning shoulder engages the second side wall of the housing.

9. A connector as in claim 8 wherein the positioning shoulder further comprises an edge extending generally orthogonal to the second contact beam for positioning the connector relative to a circuit board.

10. A connector as in claim 7 wherein the first contact beam further comprises a ramped edge adjacent the first upper locking edge and aligned for deflecting the first contact beam toward the second contact beam during insertion of the terminal into the housing.

11. An electrical connector for an LCD cluster, said connector comprising an elongated housing comprising opposed longitudinally extending first and second side walls and opposed upper and lower faces, an elongated slot intermediate said side walls and extending into the upper face of the housing, at least one terminal receiving cavity defined in the housing and extending from the slot toward the lower face of the housing and a terminal engaged in each said terminal receiving cavity, said terminal comprising an elongated base disposed generally adjacent the lower face of the housing, said base having opposed first and second ends with the first end being disposed generally adjacent the first side wall of the housing and the second end of the base being disposed for electrical connection to a circuit, first and second contact beams extending from the base at locations thereon intermediate the first and second ends of the base and extending into the slot for electrically contacting an LCD cluster inserted into the slot, wherein the improvement comprises:

upper and lower locking surfaces in each terminal receiving cavity adjacent at least the second side wall, upper and lower locking edges on the terminal engaged respectively with the upper and lower locking surfaces on the second side wall of the housing, said terminal further comprising a positioning shoulder engaging an external surface on the second side wall of the housing for redundant locking of the terminal in the terminal receiving cavity of the housing.

12. An electrical connector as in claim 11 wherein each terminal receiving cavity defines upper and lower locking surfaces adjacent each of the first and second side walls of the housing. and wherein each said terminal defines first upper and lower locking edges for engaging the locking surfaces adjacent the first side wall and second upper and lower locking edges for engaging the locking surfaces adjacent the second side wall.

13. An electrical connector as in claim 12 wherein each terminal receiving cavity defines a first vertical surface intermediate the upper and lower locking surfaces adjacent the first side wall and a second vertical surface intermediate the upper and lower locking surfaces adjacent the second side wall, said terminal defining first and second vertical edges for lockingly engaging the first and second vertical surfaces of the housing.

14. An electrical connector as in claim 13 wherein each said terminal receiving cavity is defined by first and second notches adjacent the bottom face of the housing and extending into the respective first and second side walls, the first and second lower locking edges of each terminal being lockingly engaged in the respective notches.

15. An electrical connector as in claim 11 wherein the positioning shoulder defines a positioning edge extending substantially parallel to the base of the terminal. said positioning edge being dimensioned and disposed for accurately positioning the connector relative to a circuit board.

* * * * *